United States Patent [19]

Parker et al.

[11] 4,373,460

[45] Feb. 15, 1983

[54] SEWING MACHINE LOOPERS

[75] Inventors: William R. Parker, Mt. Prospect; Matt J. Gosche, Franklin Park, both of Ill.

[73] Assignee: Union Special Corporation, Chicago, Ill.

[21] Appl. No.: 900,049

[22] Filed: Apr. 26, 1978

[51] Int. Cl.[3] ..... D05B 57/06

[52] U.S. Cl. ..... 112/162

[58] Field of Search ..... 112/197, 199, 162, 165, 112/166

[56] References Cited

U.S. PATENT DOCUMENTS

| | | | |
|---|---|---|---|
| 1,000,134 | 8/1911 | Weis | 112/162 |
| 1,076,991 | 10/1913 | Moffatt | 112/166 |
| 1,878,146 | 9/1932 | Huber | 112/162 |
| 2,516,665 | 7/1950 | Ambye | 112/218 |
| 2,636,462 | 4/1953 | Peterson et al. | 112/162 |
| 3,333,560 | 8/1967 | Wiener et al. | 112/199 |

FOREIGN PATENT DOCUMENTS

| | | | |
|---|---|---|---|
| 1063016 | 8/1959 | Fed. Rep. of Germany | 112/197 |

*Primary Examiner*—W. C. Reynolds

*Attorney, Agent, or Firm*—John A. Schaerli; J. Arthur Swanson

[57] ABSTRACT

A combination of a thread carrying upper looper and a thread carrying lower looper which along with a thread carrying needle cooperate together in an overedge industrial sewing machine in which the thread carrying upper looper has its thread carrying groove located closer to the bottom edge of the blade face than to the upper edge of the blade face and has its point located above the thread carrying groove and is closer to the upper edge than to the lower edge. The blade of the thread carrying lower looper has a generally flat bottom surface having a 2° rise starting ⅜" from its point and extending to the point.

5 Claims, 23 Drawing Figures

FIG. 7
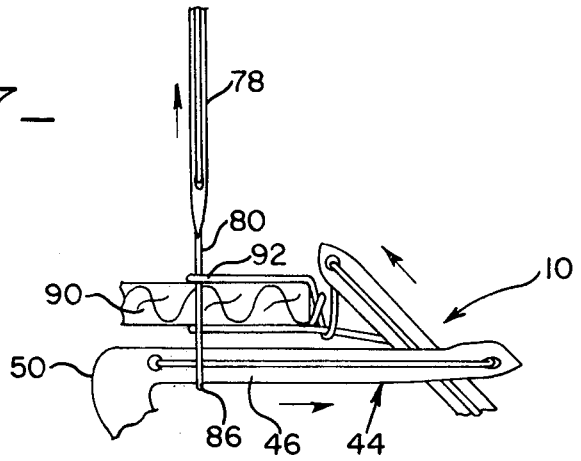
FIG. 8
PRIOR ART
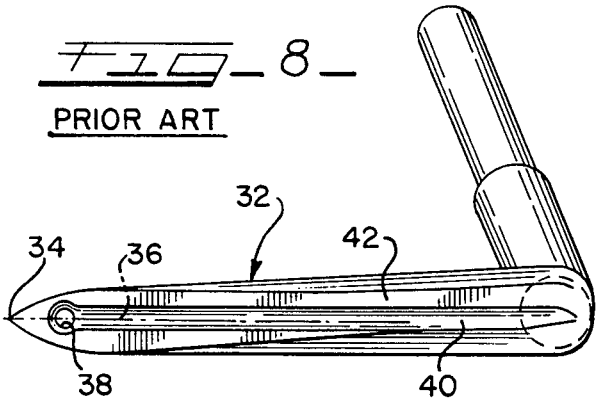
FIG. 11
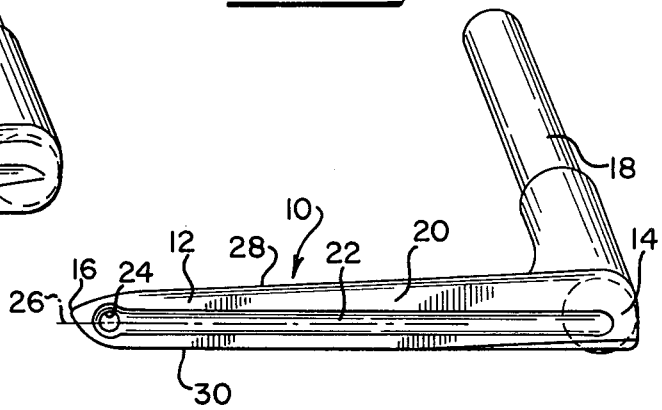
FIG. 10
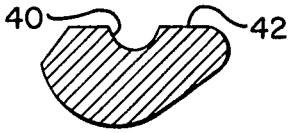
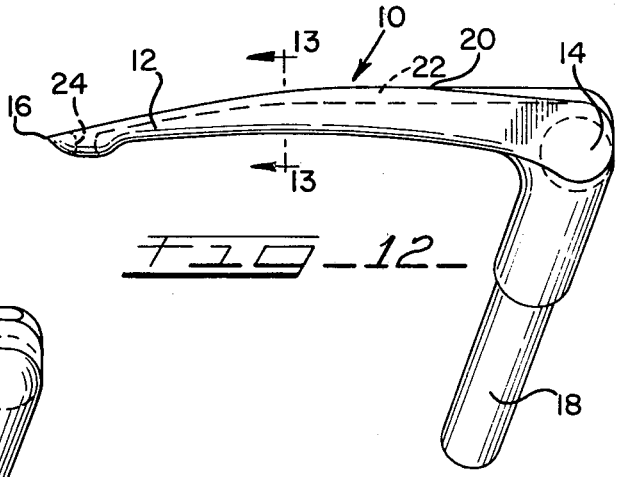
FIG. 12
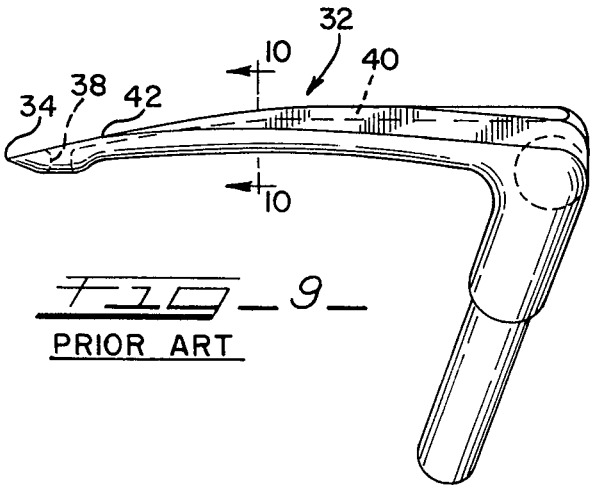
FIG. 9
PRIOR ART
FIG. 13
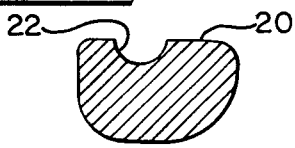

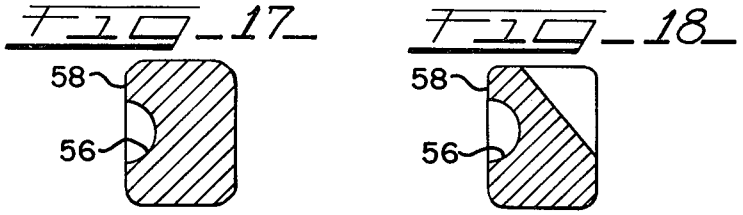
FIG. 17
FIG. 18
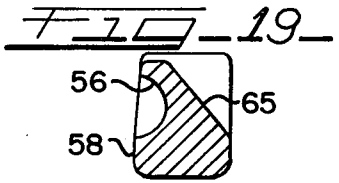
FIG. 19
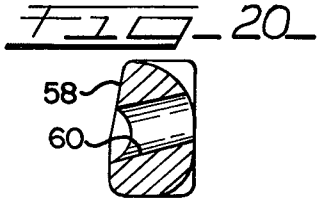
FIG. 20
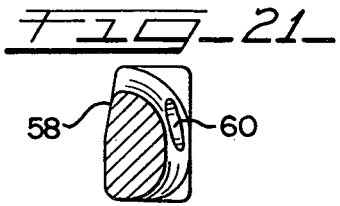
FIG. 21
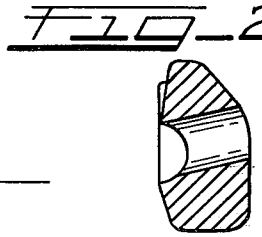
FIG. 22
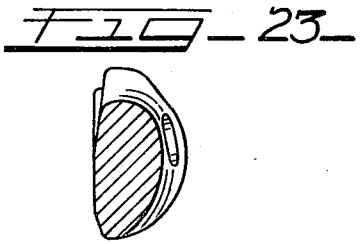
FIG. 23
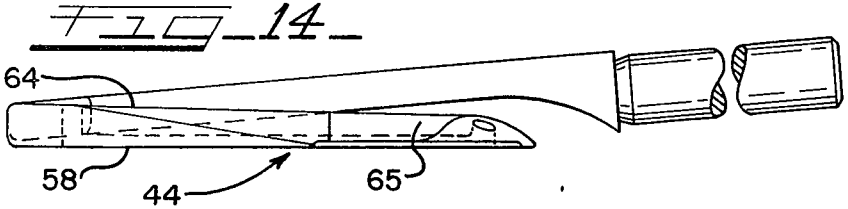
FIG. 14
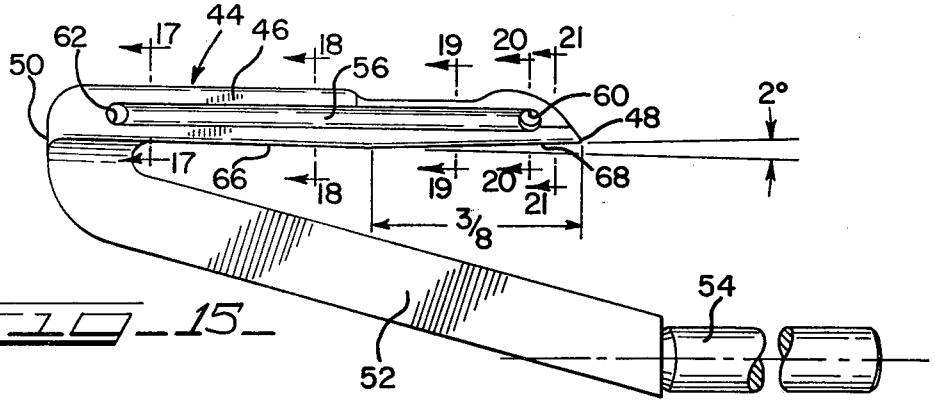
FIG. 15
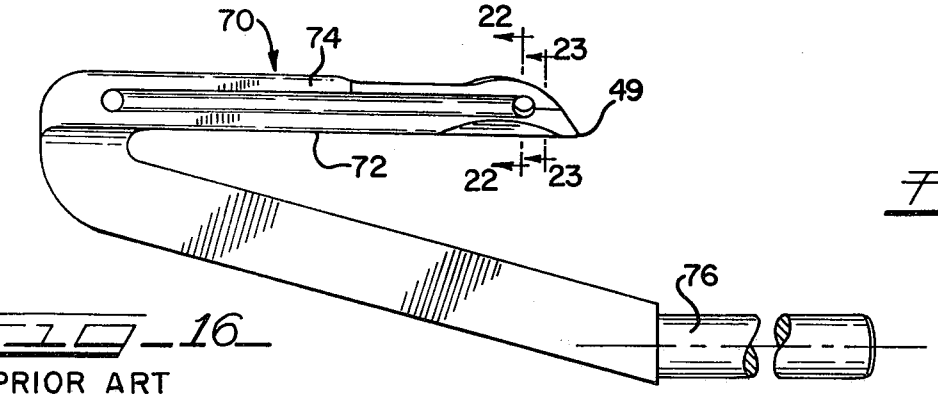
FIG. 16 PRIOR ART

SEWING MACHINE LOOPERS

This invention relates to sewing machine loopers and more particularly to thread carrying sewing machine loopers used in sewing machines that produce a three thread overedge stitch.

BACKGROUND OF THE INVENTION

A three thread overedge stitch is formed on the edge of the material, preventing the material from unravelling. Also when used on two plies of material it holds the plies together near their edges. The elements required to form a three thread overedge stitch include the needle, the upper looper, and the lower looper. These elements cooperate in a predetermined manner to form the stitch. In their paths of movement, they all pass extremely close to one another.

Many of today's industrial sewing machines are operated at extremely high speeds, up to 8000 stitches per minute. At these high speeds many sewing problems occur, such as non-uniform stitches, skipped stitches, and thread breakage. These same problems are also encountered when sewing heavy weight material. As a result, adjustment of the needle and the upper and lower loopers in relation to each other becomes very critical at these high speeds and when sewing extremely heavy weight materials.

DESCRIPTION OF PRIOR ART

Standard thread carrying upper loopers generally known in the art consist of a pointed end blade extending to a heel end joined to a butt end shank. The face of the blade contains a thread groove extending from the heel end to an eye that goes through the blade near the point. The groove and eye are essentially centered along the face as is the point. When sewing extremely heavy weight material the point of the upper looper often pierces the previously formed stitch creating a ragged appearing stitch or breaking thread. Extensive piercing often causes the upper looper to come loose in its holder or to break.

Standard thread carrying lower loopers generally known in the art consist of a beaked end blade extending to a heel end joined to an angled base portion formed with a shank end. The front face of the blade contains a lengthwise thread groove terminating at an eye near each end of the blade. The eyes extend through the blade, one located near the heel end the other near the beaked end. The bottom face is essentially flat extending to the point of the beak. When sewing at extremely high speeds, 8000 stitches per minute range, the tension in the threads increase and there is less slack in the threads. With the increase in thread tension often the needle thread loop does not slide off the looper point freely, therefore causing a non-uniform stitch or broken thread. The decrease in thread slack results in the formation of a smaller needle thread loop leading to needle thread loop skips.

SUMMARY OF THE INVENTION

The invention here under consideration is a combination of a thread carrying upper looper and a thread carrying lower looper which along with a thread carrying needle cooperate together in an overedge industrial sewing machine. The thread carrying upper looper has its thread carrying groove located closer to the bottom edge of the blade face than to the upper edge of the blade face.

Additionally, the point of the looper is located above the thread carrying groove and closer to the upper edge than the lower edge of the looper. Having the looper point closer to the upper edge than the lower edge of the looper face prevents the looper point from piercing the previously set stitch when sewing on extremely heavy material because the point is further away from the previously set stitch. Additionally, with the point of the upper looper closer to the upper edge than the lower edge of the blade face the point then enters the lower looper thread triangle at the bottom of the lower looper scarf. This is the most advantageous spot, since it is as far away from the lower looper thread as it possibly can get, thus preventing lower looper thread triangle skips.

Also under consideration is a thread carrying lower looper for an overedge industrial sewing machine in which the generally flat bottom surface of the blade has a 2° rise at the pointed end. This 2° surface enables the needle thread loop to slide off the lower looper point with less resistance when sewing at high speeds. In addition, when picking up the needle thread loop, it offers less resistance and aids in preventing needle thread loop skips.

Having a generally flat bottom surface with no 2° rise at the pointed end, the needle thread loop will not slip off the lower looper freely preventing the needle thread loop from getting pulled up tightly into the material therefore producing a non uniform stitch.

It is therefore an object of this invention to provide an improved thread carrying upper looper and an improved thread carrying lower looper for an industrial overedge sewing machine which work together to prevent lower looper thread triangle skips.

Another object of this invention is to provide an improved thread carrying upper looper that works with an improved thread carrying lower looper for an industrial overedge sewing machine to produce a more uniform stitch.

Another object of the invention is to provide an improved thread carrying upper looper for an industrial overedge sewing machine that will not pierce the previously formed stitch when sewing on extremely heavy material.

Another object of the invention is to provide an improved thread carrying upper looper for an industrial overedge sewing machine to produce a more uniform stitch.

Another object of the invention is to provide an improved thread carrying upper looper for an industrial overedge sewing machine to prevent lower looper thread triangle skips.

Another object of the invention is to provide an improved thread carrying lower looper for an industrial overedge sewing machine to allow the needle thread loop to slip off freely.

Another object of the invention is to provide an improved thread carrying lower looper for an industrial overedge sewing machine to prevent needle thread loop skips.

But another object of the invention is to provide an improved thread carrying lower looper for an industrial overedge sewing machine to produce a more uniform stitch.

According to the invention, the improved upper looper having its point located closer to the upper edge than the lower edge of the looper blade face aids in preventing the upper looper point from piercing the previously set stitch when sewing extremely heavy weight material. Additionally having the point located near the top edge of the looper blade face helps prevent lower looper thread triangle skips when sewing at extremely high speeds, such as 8000 stitches per minute.

Further according to the invention the improved lower looper whose generally flat bottom surface of the blade has a 2° rise at the beak end which when sewing at extremely high speeds, such as 8000 stitches per minute, allows the needle thread loop to shed off the lower looper freely and aids in preventing needle thread loop skips all resulting in a more uniform appearing stitch.

With the above objects, features and advantages of the invention in mind, an illustrative embodiment of the same will now be described in some detail in relation to the accompanying drawings in which:

FIG. 7 is an end view of FIG. 4;

FIG. 8 is a front plan view of a typical prior art upper looper used in an industrial overedge sewing machine.

FIG. 9 is a bottom view of a typical prior art upper looper used in an industrial sewing machine.

FIG. 10 is a view in cross section taken along lines 10—10 of FIG. 9.

FIG. 11 is a front plan view of the improved upper looper used in an industrial overedge sewing machine.

FIG. 12 is a bottom view of the upper looper shown in FIG. 11.

FIG. 13 is a view in cross section taken along lines 13—13 of FIG. 12.

FIG. 14 is a top plan view of the improved lower looper used in an industrial overedge sewing machine.

FIG. 15 is a front plan view of the lower looper shown in FIG. 14.

FIG. 16 is a front plan view of a typical prior art lower looper used in an industrial overedge sewing machine.

FIG. 17 is a view in cross section taken along lines 17—17 of FIG. 15.

FIG. 18 is a view in cross section taken along lines 18—18 of FIG. 15.

FIG. 19 is a view in cross section taken along lines 19—19 of FIG. 15.

FIG. 20 is a view in cross section taken along lines 20—20 of FIG. 15.

FIG. 21 is a view in cross section taken along lines 21—21 of FIG. 15.

FIG. 22 is a view in cross section taken along lines 22—22 of FIG. 16.

FIG. 23 is a view in cross section taken along lines 23—23 of FIG. 16.

Figure 1:
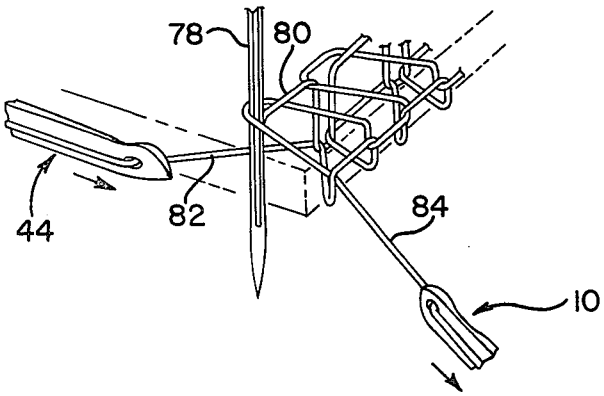
FIGS. 1, 2, 3, 4, 5 and 6 are perspective views diagrammatically illustrating six successive stages in the formation of a three thread overedge stitch.

Referring now to the drawings and more particularly to FIGS. 11, 12 and 13 where there is shown an upper looper 10 for an industrial sewing machine that sews an overedge stitch (Federal Stitch Type 504). An overedge sewing machine of this type is disclosed in U.S. Pat. No. 3,688,711 to H. Szostak et al. granted Sept. 5, 1972. The upper looper 10 is comprised of a looper blade 12 extending from a heel portion 14 to a pointed end 16. The heel portion 14 is joined to a butt end shank 18. The front face 20 of the looper blade 12 has a thread groove 22 extending lengthwise from the heel portion 14 to an eye 24 that is adjacent to the pointed end 16. The point of the looper 16 is located above the center line 26 of the eye and thread groove 24, 22 and is closer to the upper edge 28 of the face 20 than the lower edge 30 of the face 20 therefore preventing the upper looper point 16 from piercing the previously set stitch when sewing on extremely heavy material and also aiding the upper looper to enter the lower looper thread triangle when sewing at high speeds, 8000 stitches per minute range preventing lower looper thread skips. The thread groove 22 and the eye 24 are located closer to the bottom edge 30 of the face 20 than the upper edge 28.

Referring now to FIGS. 8, 9, and 10, there is shown a standard upper looper 32 in which the looper point 34 is longer than the looper point 16 in the present embodiment. Also the looper point 34 is located on the center line 36 of the eye 38 and thread groove 40. The eye 38 and thread groove 40 are centered on the face 42 of the upper looper 32. All other parts of the upper looper 32 are the same as those shown in present embodiment in FIGS. 11, 12 and 13.

Referring now to FIGS. 14, 15, 17, 18, 19, 20 and 21, there is shown a lower looper 44 for an overedge industrial sewing machine. The lower looper 44 is comprised of a looper blade 46 having a beaked end 48 and the other end terminating at a heel portion 50 that joins an angled base portion 52 formed with a shank end 54. There is a thread groove 56 lengthwise in the front face 58 of the looper blade one end terminating at an eye 60 adjacent to the beaked end 48 and the other end terminating at an eye 62 adjacent to the heel portion 50. The thread that is carried by the lower looper 44 passes from the back side of the looper blade 46 through eye 62 lies in groove 56 and then passes through eye 60 to the back side 64 of the looper blade 46. The bottom face 66 is generally flat, horizontal and parallel to the centerline of the shank 54 except for at the beak end it rises 2° starting $\frac{3}{8}''$ from the point of the beak 48 therefore enabling the needle thread loop to shed off the lower looper beak 48 with less resistance and enabling the lower looper to further enter into the needle thread loop skips when sewing at high speeds, such as 8000 stitches per minute. The beak 48 is located where the front face 58 and the free end of the 2° angled portion 68 of the bottom face 66 meet. The pointed beak blends in with the back face 64 and the bottom 2° angled face 68. There is an angled surface, called a scarf 65 on the back face 64 located behind the eye 60, with its maximum depth at its end next to eye 60.

Referring now to FIGS. 16, 22 and 23 there is shown a standard lower looper 70 in which the bottom face 72 of the looper blade 74 is essentially flat, horizontal and parallel to the centerline of the shank 76 containing no angled portion as in the present embodiment. All other parts of the looper 70 are the same as those shown in the present embodiments.

Figure 3:
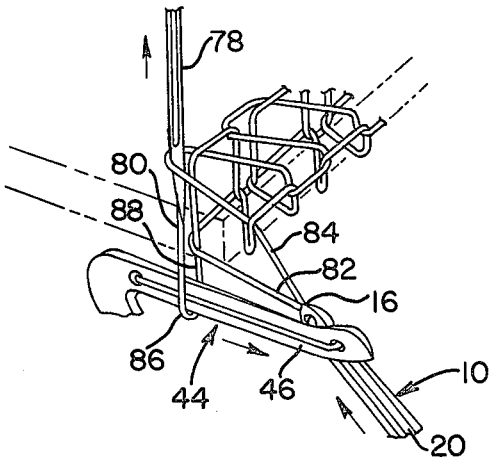
Figure 2:
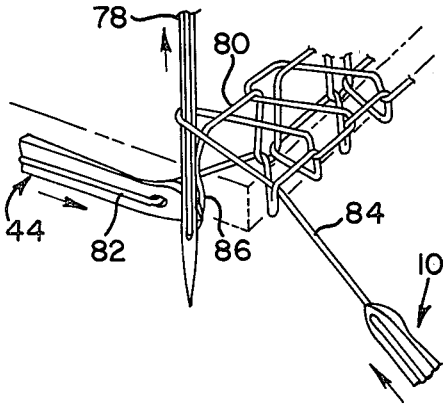
Figure 4:
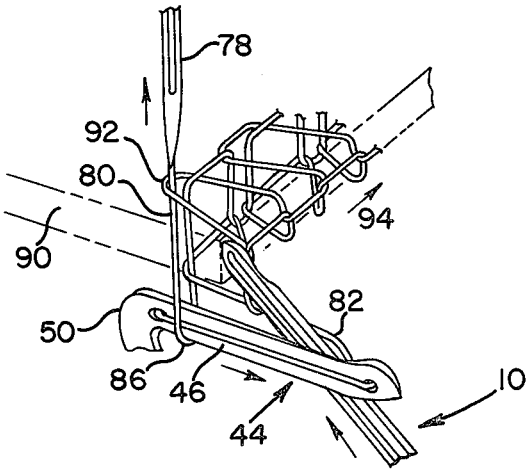
Figure 5:
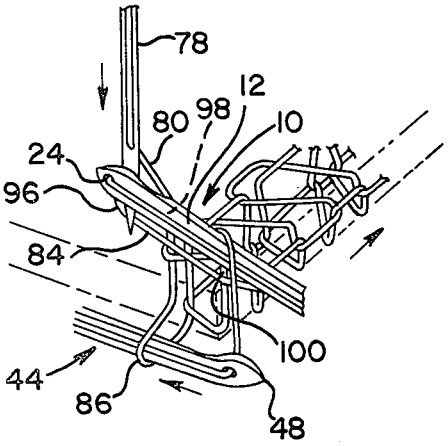
Figure 6:
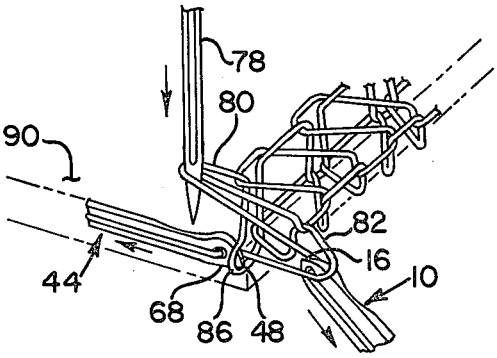

The formation of the stitch (Federal Stitch Type 504) is illustrated in FIGS. 1 through 6 showing the relating movements of the needle 78, lower looper 44 and the upper looper 10. The stitch consists of three separate threads; a needle thread 80 carried by the needle 78 a lower looper thread 82 carried by the lower looper 44 and an upper looper thread 84 carried by the upper looper 10. In FIG. 1 the needle 78 is at its lowest position, the lower looper 44 is starting to move to the right from its extreme left position and the upper looper 10 is descending to the right. In this position the previously formed stitch is being set on the material with the aid of the descending needle, and the movement of the loopers in addition to take up levers not shown. In FIG. 2 the needle 78 is beginning to rise causing a loop 86 to form in the needle thread 80 behind the needle with the point 48 of the lower looper 44 entering said needle thread loop 86 and the upper looper 10 is at its lowest to the right position. In FIG. 3 the needle 78 is still rising, the lower looper 44 is moving to the right with the needle thread loop 86 wrapped around its blade 46 and has formed a triangle, the lower looper blade 46, the back leg 88 of the needle thread loop 86 and the lower looper thread 82, into which the upper looper point 16 enters as the upper looper 10 is rising to the left. The upper looper 10 passes extremely close to the lower looper 44 with its point 16 entering said triangle at the scarf 65 on the back side of the lower looper 44. The upper looper face 20 is at a slight angle to the backface 64 of the lower looper 44 as the upper looper 10 passes the lower looper 44. The scarf 65 is at this angle lengthwise on the lower looper 44, resulting in the upper edge 28 of the face 20 passing at the maximum depth of the scarf 65. In FIGS. 4 and 7 the needle 78 is still rising, leaving the material 90 and the upper looper thread loop 92. The lower looper 44 has reached its extreme right position with the needle thread loop 86 wrapped around its blade 46 and is sliding towards the heel 50 of the lower looper 44. The upper looper 10 is rising up over and very close to the previously formed stitch and the feed (not shown) is beginning to feed the material 90 in the direction of arrow 94. In FIG. 5, the needle 78 is beginning to descend, entering the upper looper thread loop 96 or the triangle formed by the back side 98 of the upper looper blade 12, upper looper thread 84 that extends from the eye 24 of the upper looper 10 to the previously formed stitch and the back leg 100 of the lower looper thread loop 82 that goes over upper looper 10. The upper looper 10 has reached its highest point of travel over the edge of the material 90 to allow the needle 78 to enter the above mentioned triangle. Lower looper 44 is moving toward the left and the needle thread loop 86 around it begins to slide towards the beak end 48 of the lower looper and the feed is still feeding the material 90. In FIG. 6, the needle 78 is still descending and has now entered the material 90, the upper looper 10 is descending to the right and the lower looper thread 82 around the upper looper 10 is sliding toward the point 16 of the upper looper, the lower looper 44 is still moving toward the left and the needle thread loop 86 around the lower looper 44 is beginning to slip off the point of the lower looper 44. The feed has stopped feeding the material 90. Now returning to FIG. 1 to complete one full cycle and form one complete stitch the needle 78 has passed through the material 90 and has reached its lowest position, the lower looper 44 has dropped or released from its point 48 the needle thread loop 86 and reached its extreme left position and the upper looper 10 has released from its point 16 the lower looper thread 82 that was around it as it is descending to the right.

By comparing the preferred embodiment shown in FIG. 11, 12 and 13 with the standard upper looper shown in FIGS. 8, 9 and 10 and referring to the formation of the stitch shown in FIGS. 4 and 7 the advantages of the present invention can be seen. As the upper looper is rising upward passing over very close to the previously formed stitch it is seen that with the upper looper point 16 being further away from the lower edge 30 of the looper face 20 there will be less tendency for the looper point 16 to pierce the stitch when the material being sewn is extremely heavy. When the previous stitch is pierced, thread breakage occurs resulting in a ragged looking stitch or the upper looper becoming unthreaded and therefore the sewing machine has to be stopped and rethreaded.

In FIG. 3 the upper looper 10 passes extremely close to the lower looper 44 at the scarf 65 when entering the triangle formed by the lower looper blade 46, the back leg 88 of the needle thread loop 86 and the lower looper thread 82. This closeness is necessary because at extremely high speeds, 8000 stitches per minute range, there is less slack in the threads and the tension in the threads increases resulting in the lower looper thread 82 lying very close to the back face 64 of the lower looper blade 46, especially at the point end eye area 60 leaving a very small opening between the lower looper thread 82 and the lower looper blade 46 for the upper looper point 16 to enter. The scarf 65 on the lower looper 44 increases the size of the opening and has its maximum depth at its end towards the point 48. Therefore with upper looper point 16 being located closer to the upper edge 28 than the lower edge 30 of the upper looper face 20 as it is on the preferred embodiment the upper looper point 16 enters the triangle further into the scarf 65 aiding in the prevention of lower looper thread skips.

By comparing the preferred embodiment shown in FIGS. 15 and 21 with the standard lower looper shown in FIGS. 16 and 23 and referring to the formation of the stitch shown in FIGS. 2 and 6, the advantages of the present invention can be seen. In FIG. 2 the lower looper 44 is just beginning to enter the needle thread loop 86 and with the looper beak 48 being raised above the bottom face 66 by the 2" angle it will be further into the loop before the lower side of the loop comes into contact with the bottom face than if the bottom face were flat with no 2° rise. Since the standard looper 70 has its beak 49 on the bottom face 72 it will not be as far into the needle thread loop when the loop comes into contact with the bottom face. Therefore with the standard lower looper 70 there is a greater chance of the needle thread loop 86 not getting picked up by the lower looper causing needle loop skips. This is definitely more beneficial at extremely high speeds, 8000 stitches per minute range because the needle thread loop 86 formed as the needle 78 rises from the bottom of its stroke is smaller than at lower speeds due to less slack in the needle thread.

In FIG. 6, the needle thread loop 86 is just starting to slip off of the lower looper beak 48. The lower looper 44 having a bottom face 68 rising at 2° at the beak will offer less resistance to the needle thread loop 86 slipping off the beak 48 than if the bottom face was essentially flat and horizontal as it is on the standard lower looper 70. Ease of the needle thread loop 86 slipping off the lower looper beak 48 aids in allowing the needle thread loops to be pulled up to the material uniformly. Slipping off easily gives the needle 78 and needle thread take up (not shown) sufficient time to pull up a uniform stitch. This less resistance aids greatly at extremely high speeds, 8000 stitches per minute range, because of the increase in thread tension causing needle thread breakage of the needle thread loop 86 as it resists slipping off the lower looper beak 48.

A thread carrying sewing machine upper looper used in a sewing machine that produces a three thread overedge stitch has been provided with its pointed end located above the center line of the eye and thread groove and closer to the upper edge than the lower edge of the looper face resulting in the prevention of the upper looper point from piercing the previously formed stitch when sewing extremely heavy weight material. Additionally when sewing at extremely high speeds, 8000 stitches per minute range, this relocated looper point aids in the prevention of lower looper thread skips because it can be adjusted to pass the lower looper deeper into its scarf.

A thread carrying sewing machine lower looper used in a sewing machine that produces a three thread overedge stitch has been provided with a generally flat bottom surfaced blade having a 2° rise at the pointed end resulting in the needle thread loop that is around the lower looper to shed off easily allowing it to be pulled up into the material more uniformly at extremely high speeds such as 8000 stitches per minute. Also the 2° rise on the bottom face helps prevent needle thread loop skips by allowing the lower looper beak 48 to enter further into the needle thread loop before the needle rises and the bottom of the loop makes contact with the bottom face of the lower looper when sewing at extremely high speeds.

Having thus described the invention, what is claimed herein is:

1. A three thread overedge stitch sewing machine having sewing instrumentalities comprising:

a thread carrying needle;

a thread carrying upper looper including:

a point end means;

a heel portion means;

a blade means having a front face means extending from said upper looper point end means to said upper looper heel portion means, said upper looper front face means having an upper edge means and a lower edge means;

a butt end shank means joined to said upper looper heel portion means;

a thread groove means located in said upper looper front face means of said upper looper blade means; and eye means located in said upper looper blade means at said upper looper point end means, said upper looper thread groove means terminating at said upper looper eye means, said upper looper point end means being disposed between the center line of said upper looper thread groove and eye means and the upper edge of said upper looper front face means, whereas to prevent said upper looper point end means from piercing the previously set stitch when sewing extremely heavy weight material; and, a thread carrying lower looper including:

a beak end means;

a heel portion means;

a blade means having a front face means extending from said lower looper beak end means to said lower looper heel portion means;

an angled base portion means formed with a shank end means and joined to said lower looper heel portion means;

two eye means located in said lower looper blade means, one of said lower looper eye means being in proximity of said lower looper beak end means and the other of said lower looper eye means being in proximity of said lower looper heel portion means;

a lengthwise thread groove means located in said lower looper front face means of said lower looper blade means, one end terminating at said lower looper beak end eye means and the other end terminating at said lower looper heel portion eye means; and a bottom face portion means being generally flat and extending the length of said lower looper blade and having a 2° rise at said lower looper beak end means whereas to prevent needle thread loop skips when sewing at extremely high speeds, 8000 stitches per minute range.

2. A thread carrying upper looper that cooperates with a thread carrying lower looper and a thread carrying needle to produce a three thread overedge stitch for a sewing machine comprising:

a point end means;

a heel portion means;

a blade means having a front face means extending from said upper looper point end means to said upper looper heel portion means, said upper looper front face means having an upper edge means and a lower edge means;

a butt end shank means joined to said upper looper heel portion means;

a thread groove means located in said upper looper front face means of said upper looper blade means; and eye means located in said upper looper blade means at said upper looper point end means, said upper looper thread groove means terminating at said upper looper eye means, said upper looper point end means being disposed between the centerline of said upper looper thread groove means and eye means and the upper edge of said upper looper front face means, whereas to prevent said upper looper point end means from piercing the previously set stitch when sewing extremely heavy weight material.

3. The thread carrying upper looper for a sewing machine of claim 2 wherein:

said point means is disposed closer to the upper edge than the lower edge of said front face means of said blade means.

4. A thread carrying lower looper that cooperates with a thread carrying upper looper and a thread carrying needle to produce a three thread overedge stitch for a sewing machine comprising:

a beak end means;

a heel portion means;

a blade means having a front face means extending from said lower looper beak end means to said lower looper heel portion means;

an angled base portion means formed with a shank end means and joined to said lower looper heel portion means;

two eye means located in said lower looper blade means, one of said lower looper eye means being in proximity of said lower looper beak end means and the other of said lower looper eye means being in proximity of said lower looper heel portion means;

a lengthwise thread groove means located in said lower looper front face means, one end terminating at said lower looper beak end eye and the other end terminating at said lower looper heel portion eye; and a bottom face portion means being generally flat and extending the length of said lower looper blade and having a 2° rise at said lower looper beak end means whereas to prevent needle thread loop skips when sewing at extremely high speeds, 8000 stitches per minute range.

5. The thread carrying lower looper for a sewing machine of claim 4 wherein:

said 2° angled bottom face means starts its rise $\frac{3}{8}''$ from said lower looper beak end means.

* * * * *